US010562663B2

(12) United States Patent
Mowbray et al.

(10) Patent No.: US 10,562,663 B2
(45) Date of Patent: Feb. 18, 2020

(54) APPARATUS FOR HOUSING AND REVEALING A PLURALITY OF CHILDREN'S TOYS

(71) Applicants: Mathew Peter Mowbray, Cambridge (NZ); Adam Steven Woods, Melbourne (AU)

(72) Inventors: Mathew Peter Mowbray, Cambridge (NZ); Adam Steven Woods, Melbourne (AU)

(73) Assignee: CREATIVE IMPACT INC., Tortola (VG)

( * ) Notice: Subject to any disclaimer, the term of this patent is extended or adjusted under 35 U.S.C. 154(b) by 73 days.

(21) Appl. No.: 15/897,569

(22) Filed: Feb. 15, 2018

(65) Prior Publication Data

US 2018/0229885 A1 Aug. 16, 2018

Related U.S. Application Data

(60) Provisional application No. 62/459,471, filed on Feb. 15, 2017.

(51) Int. Cl.
*B65D 8/00* (2006.01)

(52) U.S. Cl.
CPC ..... *B65D 11/02* (2013.01)

(58) Field of Classification Search
CPC ..... B65D 2543/00694; B65D 2543/00805; B65D 2543/00296; B65D 75/24; B65D 77/003; B65D 11/00; B65D 11/02; B65D 11/18; B65D 25/04; B25H 3/023
USPC ..... 220/4.26, 4.27
See application file for complete search history.

(56) References Cited

U.S. PATENT DOCUMENTS

| | | | | | |
|---|---|---|---|---|---|
| 1,409,082 | A | * | 3/1922 | Corbett | A63F 9/12 273/157 R |
| 1,524,367 | A | | 1/1925 | Papageorge | |
| 3,857,838 | A | * | 12/1974 | Perronnet | C07D 471/04 544/48 |
| 4,765,501 | A | * | 8/1988 | Kao | B65D 11/02 220/4.21 |
| 5,676,253 | A | * | 10/1997 | Hsu | B25H 3/023 206/372 |
| 5,792,496 | A | * | 8/1998 | Fekete | A23G 3/50 220/4.21 |
| D463,120 | S | * | 9/2002 | Yoshinaka | D3/276 |
| D468,535 | S | * | 1/2003 | McCormack | D3/273 |

(Continued)

FOREIGN PATENT DOCUMENTS

| | | | |
|---|---|---|---|
| DE | 202007002562 | U1 | 7/2008 |
| DE | 102015101080 | A1 | 7/2016 |
| FR | 1193845 | A | 11/1959 |

OTHER PUBLICATIONS

Written Opinion of the International Searching Authority for PCT/IB2018/050887.

*Primary Examiner* — Shawn M Braden
(74) *Attorney, Agent, or Firm* — Dentons US LLP

(57) ABSTRACT

An apparatus comprising a plurality of bodies which can be assembled together to form a singular three-dimensional body.
The bodies each a cavity within which a child's toy can be received. Each cavity has a cavity opening through which said child's toy can be viewed, accessed and/or withdrawn from the cavity. The cavity opening is obstructed by an adjacent one of the plurality of bodies when the plurality of bodies are in the assembled state.

10 Claims, 10 Drawing Sheets

(56) References Cited

U.S. PATENT DOCUMENTS

| | | | | |
|---|---|---|---|---|
| 8,079,472 | B2 * | 12/2011 | Gillain | B65D 85/305 206/433 |
| 9,931,579 | B1 * | 4/2018 | Garcia | A63H 3/36 |
| 9,975,058 | B2 * | 5/2018 | Yamada | A63H 33/003 |
| 2003/0234195 | A1 * | 12/2003 | Earl | B65D 25/04 206/338 |
| 2005/0029735 | A1 | 2/2005 | Liu et al. | |
| 2007/0102308 | A1 * | 5/2007 | Tremblay | B65D 11/04 206/223 |
| 2008/0230989 | A1 | 9/2008 | Chen | |
| 2010/0301558 | A1 | 12/2010 | Speegle | |
| 2011/0123687 | A1 * | 5/2011 | Gass | A23G 3/563 426/132 |
| 2015/0210432 | A1 | 7/2015 | Lam | |
| 2016/0021915 | A1 * | 1/2016 | Baxter | A47J 47/02 426/295 |

* cited by examiner

APPARATUS FOR HOUSING AND REVEALING A PLURALITY OF CHILDREN'S TOYS

RELATED APPLICATION

This application claims priority to, and claims the benefit of, the provisional patent application No. 62/459,471 entitled "Apparatus for Housing and Revealing a Plurality of Children's Toys" filed on Feb. 15, 2017, the content of which is incorporated by reference in its entirety herein.

FIELD OF THE INVENTION

The present invention relates to the packaging and/or presentation of children's toys.

BACKGROUND TO THE INVENTION

It is commonly desirable to package and present toys for sale or inspection. Conventionally toys may be packaged in clear plastic display packaging so that they can be seen and inspected prior to purchase. However in some instances toys are deliberately presented in a format which prevents them from being seen or inspected prior to purchasing and opening the package, because doing so adds an element of surprise and interest upon discovering the contents of the package.

US 20110123687 A1 discusses a capsule format for the presentation of children's toys. The capsule may be formed from two shells which fit together to define a hollow cavity in which a toy can be concealed. The two shells can be separated in order to reveal the toy. The process of revealing the toy in this manner creates an element of suspense and surprise for the child.

In addition US 20110123687 A1 discusses that the capsule may be concealed in an interior cavity of a hollow edible chocolate egg shell. The shell may be fractured, for example by biting, in order to permit access to the interior cavity, thus revealing the capsule. Again, the process of revealing a toy in this manner creates an element of suspense and surprise, and may hold the child's interest for longer than releasing a toy from conventional toy packaging.

It is therefore an object of the present invention to realise and/or improve upon at least some of the abovementioned advantages and/or to at least provide the public with a useful choice.

SUMMARY OF THE INVENTION

In one aspect the present invention can be said to consist in an apparatus comprising a plurality of bodies which can be assembled together to form a singular three-dimensional body (herein referred to as "the assembled state"), wherein at least two (and preferably all) of said plurality of bodies define a cavity within which an item can be received, and wherein said cavity has a cavity opening through which said item can be viewed, accessed and/or withdrawn from the cavity, and wherein said cavity opening is obstructed by an adjacent one of the plurality of bodies when the plurality of bodies are in the assembled state, but can be exposed by moving one or more of said plurality of bodies away from the assembled state.

In some embodiments the plurality of bodies comprises between three and six bodies.

In some embodiments each of said plurality of bodies defines a cavity within which an item is or can be received.

In some embodiments said item is a child's toy.

In some embodiments one or more of the bodies are of substantially thin-walled or at least partial shell construction.

In some embodiments one or more of the bodies are opaque.

In some embodiments the bodies are segment shaped.

In some embodiments the single three-dimensional body formed by the plurality of bodies in their assembled state is substantially spherical, cuboid, elliptical and/or polyhedral in form.

In some embodiments, in the assembled state, an outer surface of each one of the plurality of bodies, defines or is co-extensive with the outer surface of said three-dimensional body.

In some embodiments, in the assembled state, the plurality of bodies fit together with at least one outer surface of each body contiguous at least one outer surface of an adjacent body, such that the plurality of bodies jointly define a substantially continuous outer surface of said single three-dimensional body.

In some embodiments the outer surface of the three-dimensional body is substantially smooth.

In some embodiments the apparatus is configured such that the plurality of bodies may be moved away from the assembled state independently of one another.

In some embodiments the apparatus is configured such that the plurality of bodies may only be moved away from the assembled state independently of one another and one at a time.

In alternative embodiments the apparatus is configured such that the plurality of bodies can or must be moved away from the assembled state simultaneously.

In some embodiments the plurality of bodies are permanently connected to one another, and/or the apparatus.

In some embodiments the plurality of bodies are connected to one another and/or the apparatus via a hinged or pivoting connection.

In some embodiments the hinged or pivoting connection is at or near a base region of the apparatus.

In some embodiments the plurality of bodies are connected at or near a first end, and have a second free end which is able to swing about the hinge/pivot in order to move the bodies away from and back toward the assembled state.

In alternative embodiments the plurality of bodies are free from permanent connection to one another and/or the apparatus.

In some embodiments the plurality of bodies assume the assembled state by stacking upon one another and/or releasably interlocking with one another.

In some embodiments the plurality of bodies are connected in a concertina fashion, wherein the concertina is extended to move the bodies away from the assembled state and contracted to move the bodies toward the assembled state.

In some embodiments the apparatus may further comprise a retainer to restrict movement of one or more of the plurality of bodies away from the assembled state.

In some embodiments the retainer is a latch.

In some embodiments the latch engages with each of the plurality of bodies to restrict their relative movement.

In some embodiments one or more of the cavity openings is obstructed by a cover or seal.

In some embodiments the cover or seal is frangible, edible, deformable or otherwise removable.

In some embodiments the cover or seal is adhesive or heat bonded about the edges of the cavity opening, and able to be removed by peeling off.

In some embodiments each of the plurality of bodies is identical in form.

In one aspect the present invention can be said to consist in an apparatus comprising a plurality of segment shaped bodies which together assemble to jointly define a notional second body substantially in the shape of a solid of revolution, each body defining a cavity within which an item can be received, and wherein said cavity has a cavity opening through which said item can be viewed, accessed and/or withdrawn from the cavity, each of the cavity openings being concealed when the segment shaped bodies are so assembled together, and wherein said segment shaped bodies are connected to the apparatus via an articulating connection at or near a base region of the apparatus, and can hinge radially outward of the notional second body to permit access to each of the cavity openings.

In some embodiments the plurality of bodies comprises between three and six bodies.

In some embodiments said item is a child's toy.

In some embodiments one or more of the bodies are of substantially thin-walled or at least partial shell construction.

In some embodiments one or more of the bodies are opaque.

In some embodiments the bodies are segment shaped.

In some embodiments the single three-dimensional body formed by the plurality of bodies in their assembled state is substantially spherical, cuboid, elliptical and/or polyhedral in form.

In some embodiments, in the assembled state, an outer surface of each one of the plurality of bodies, is co-extensive with the outer surface of said three-dimensional body.

In some embodiments, in the assembled state, the plurality of bodies fit together with at least one outer surface of each body contiguous at least one outer surface of an adjacent body, such that the plurality of bodies jointly define a substantially continuous outer surface of said single three-dimensional body.

In some embodiments the outer surface of the three-dimensional body is substantially smooth.

In some embodiments the apparatus is configured such that the plurality of bodies may be articulated independently of one another.

In some embodiments the apparatus is configured such that the plurality of bodies may only be articulated independently of one another and only one at a time.

In alternative embodiments the apparatus is configured such that the plurality of bodies can or must be articulated simultaneously.

In some embodiments the apparatus may further comprise a retainer to restrict movement of one or more of the plurality of bodies away from the assembled state.

In some embodiments the retainer is a latch.

In some embodiments the latch engages with each of the plurality of bodies to restrict their relative movement.

In some embodiments one or more of the cavity openings is obstructed by a cover or seal.

In some embodiments the cover or seal is frangible, edible, deformable or otherwise removable.

In some embodiments the cover or seal is adhesive or heat bonded about the edges of the cavity opening, and able to be removed by peeling off.

In some embodiments each of the plurality of bodies is identical in form.

In another aspect the present invention may be said to consist in a capsule of capsule parts, the capsule obscuring from view a reward held in at least one or more of the capsule parts.

In some embodiments the reveal of a reward requires the capsule part with which it is associated to be deployed relative to adjacent capsule parts.

In some embodiments the reveal requires a removal of a cover of the reward in its capsule part.

In some embodiments the reveal does not require the capsule to be disassembled i.e. mere deployment is sufficient.

In a further aspect the present invention is an assembled item able to deploy from one form into at least substantially discrete forms, at least one of those discrete forms including a removable reward not revealed when in the undeployed one form.

In some embodiments a removable reward is in at least several or all of the discrete forms.

Optionally all of the discrete forms is of the same shape.

In some embodiments the deployment of the discrete forms keep the integrity of the assembled item.

In some embodiments the discrete forms can all be undeployed so that the item reverts to its "one" form.

The "one" form may be spherical and the deployed forms may be sectors or truncated sectors of the spherical form.

In some embodiments the deployment is by articulation and not be disassembly.

In a further aspect the present invention may be said to be a reward bearing item, the item requiring at least some splay deployment of a component or portion to allow reveal and access to the reward.

In a further aspect the present invention may be said to be a reward bearing item, the item requiring at least some splay deployment of a component or portion to allow reveal and access to the reward.

In another aspect the invention can be said to consist in an assembly of segments, the assembly for obscuring from view an item held in at least one or more of the assembly segments at least when the segments are in an assembled form, and wherein the segments are associated together so as to be able to transform from the assembled form towards an expanded form upon the disassociation of a retainer element from the assembly.

Preferably the segments each define a container or receptacle for an item to be held therein.

Preferably all segments are substantially identical.

Preferably the container or receptacle of at least one segment comprises at least one open or openable face.

Preferably where the container or receptacle of at least one segment comprises an openable face, the openable face is provided by a seal or cover element.

Preferably the seal element may be peelably removed from the container or receptacle in order to reveal an item held therein.

Preferably where the container or receptacle of at least one segment comprises an open face an item held within a segment may be revealed when the assembly moves away from the assembled form towards the expanded form.

Preferably the association of the segments to each other is by way of a pivotable connection, the pivotable connection allowing pivoting of each segment relative to the connection yet constraining the separation of the segments at the connection.

Preferably the association between at least one segment and the pivotable connection is frangible, so as to enable the at least one segment to be separated from the assembly.

Preferably the configuration of either or both of the segments and pivotable connection is such that upon the disassociation of the retainer element from the assembly the segments move away from the assembled form and towards the expanded form.

Preferably the retainer element is provided by a band encircling the assembly and constraining the segments towards their assembled form.

Preferably the retainer element is provided by a removable connecting element, the removable connecting element being located towards an opposite end of each segment than the pivotable connection.

Preferably the removable connecting element is provided in connection with each segment to retain the assembly in the assembled form yet able to be removed from connection with the segments to allow the assembly to move away from the assembled form.

Preferably the assembly is wrapped in a removeable wrapper.

In a further aspect the present invention may be said to be a method of selling a toy comprising providing an assembly or apparatus as herein defined, within each body of which a toy is housed.

In a further aspect the present invention may be said to be a method of packaging a toy by providing the toy inside of each body of the assembly or apparatus as herein defined.

In a further aspect the present invention may be said to be method of packaging a toy in body of the apparatus or assembly as herein defined by, prior to the each body being assembled to the assembled condition, locating a toy inside each body.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

Preferred embodiments of the invention will be described by way of example only and with reference to the drawings, in which.

DETAILED DESCRIPTION OF PREFERRED EMBODIMENTS

Figure 1:
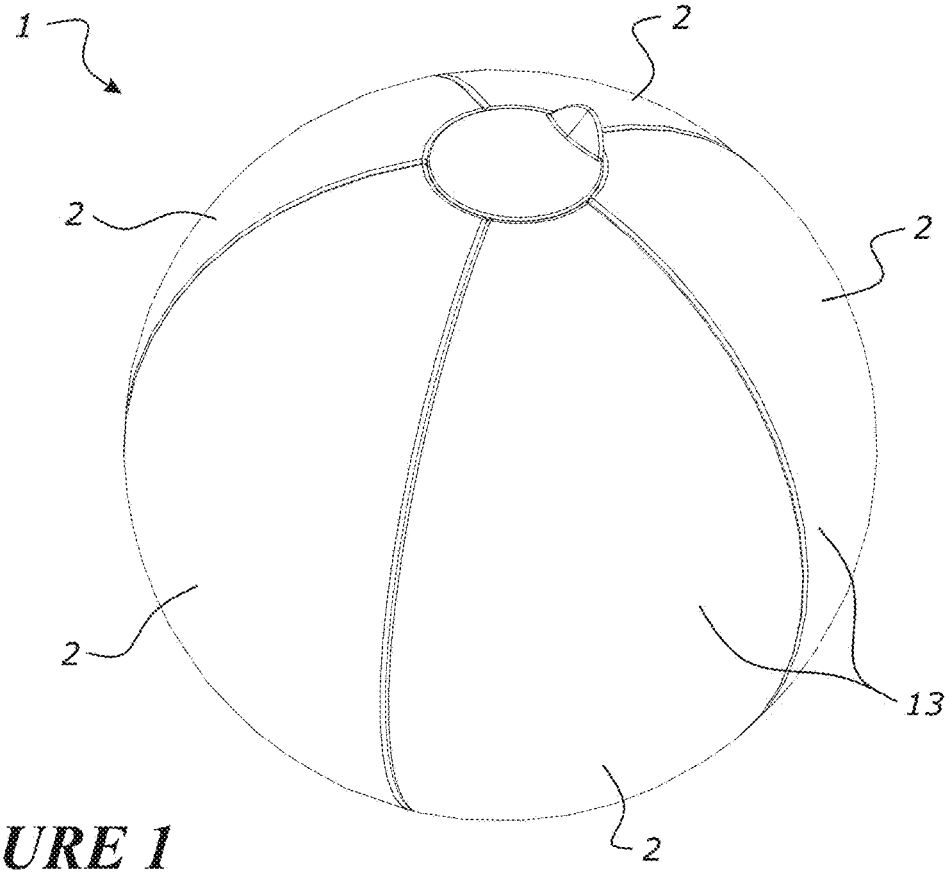
FIG. 1 shows a view of an apparatus according to an exemplary embodiment.

In some embodiments the present invention is an apparatus 1 made up of a plurality of discrete bodies 2, each defining a cavity, container or receptacle 3 within which at least one item, such as a child's toy or other item or reward 4, can be received. For example the child's toy or other reward 4 may be a figurine, keychain, model, plush toy, balloon, sticker, plastic accessory or other novelty item, including an at least partially edible novelty item. It is intended that by providing multiple bodies 2, each capable of receiving at least one item 4, a plurality of items 4 may be housed within the apparatus 1. However in some embodiments the apparatus may comprise a plurality of bodies 2 but only some of those have a cavity 3 for receiving one or more items.

In preferred embodiments the plurality of bodies 2 number between 3 and 6. In some embodiments there may be 7 to 10 bodies 2, or even more.

Figure 2:
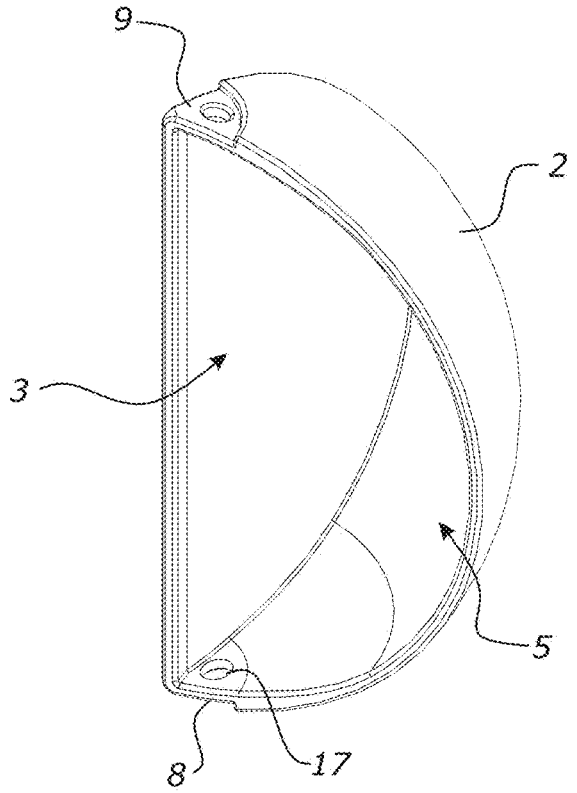
FIG. 2 shows a single body of which the apparatus may be comprised.
Figure 4:
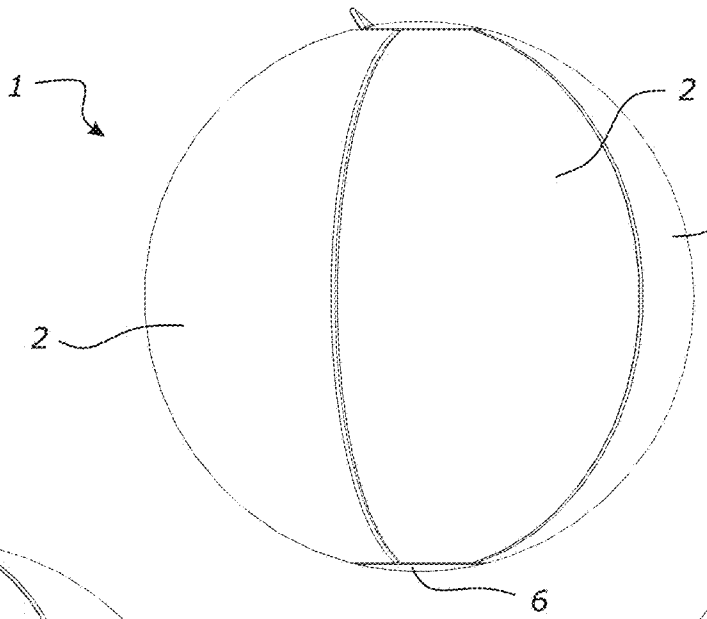
FIGS. 3-5 show various views of the apparatus of FIG. 1.
Figure 5:
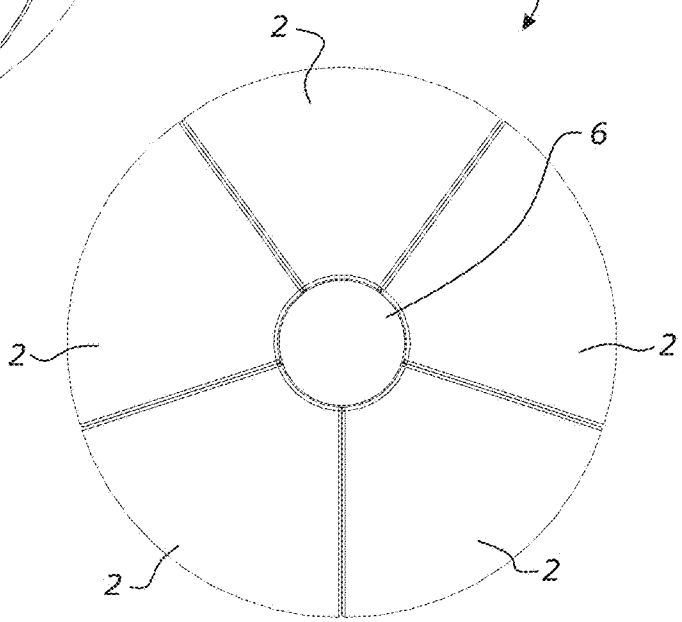
Figure 3:
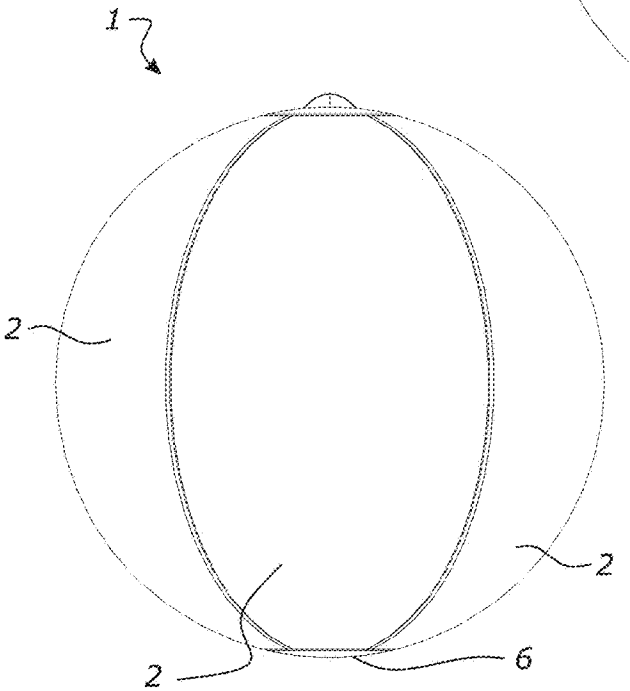

Each cavity 3 may have an opening 5 of the cavity through which an item, e.g. a reward or toy 4, housed inside the cavity 3 can be viewed, accessed and withdrawn from the cavity. In some embodiments the bodies 2 are of a thin-walled construction, so as to form an at least partial shell defining the cavity, for example as shown in FIG. 2. The body or shell 2 may be opaque so that a toy housed inside the cavity 3 can only be viewed through the opening 5.

In some embodiments the multiple discrete bodies 2 can be assembled together to form a single three-dimensional body (or notional body). The body may be, for example, of spherical, cuboid, elliptical and/or polyhedral form. A person skilled in the art will appreciate that the singular three-dimensional body formed by the assembled multiple bodies 2 could take on any manner of shapes and/or forms. However in some embodiments it is desired that in the assembled state, the multiple bodies fit together with at least one outer surface of each body contiguous at least one outer surface of an adjacent body, such that the multiple bodies together jointly define a substantially continuous outer surface 13 of the singular three-dimensional body, for example as seen in FIG. 1. Another way that this could be described is that an outer surface of each one of the plurality of bodies, is co-extensive with a notional outer surface 13 of the three-dimensional body.

Also seen in FIG. 1 is that for at least some preferred embodiments the jointly defined outer surface 13 of the singular three-dimensional body is substantially smooth. Such a feature can assist with the ease of applying an exterior overwrap to the assembled apparatus if such is desired for on shelf display at the point of purchase.

When in the assembled state, the bodies 2 may be arranged so that for each body, the opening 5 of its cavity 3 is obscured by the other bodies of the apparatus 1. Thus any items/toy(s) 4 housed inside the apparatus will be concealed when the multiple bodies 2 are in the assembled state. This is shown for example in FIGS. 1, 3-5, 16 and 19. However the bodies 2 may be moveable away from the assembled state. The apparatus may be configured such that for each of the multiple bodies, such deployment from the assembled state causes the opening 5 of the cavity 3 to be revealed, and thus any items/toy(s) 4 housed inside the cavity will come viewable, accessible and/or able to be withdrawn from the cavity.

Figure 6A:
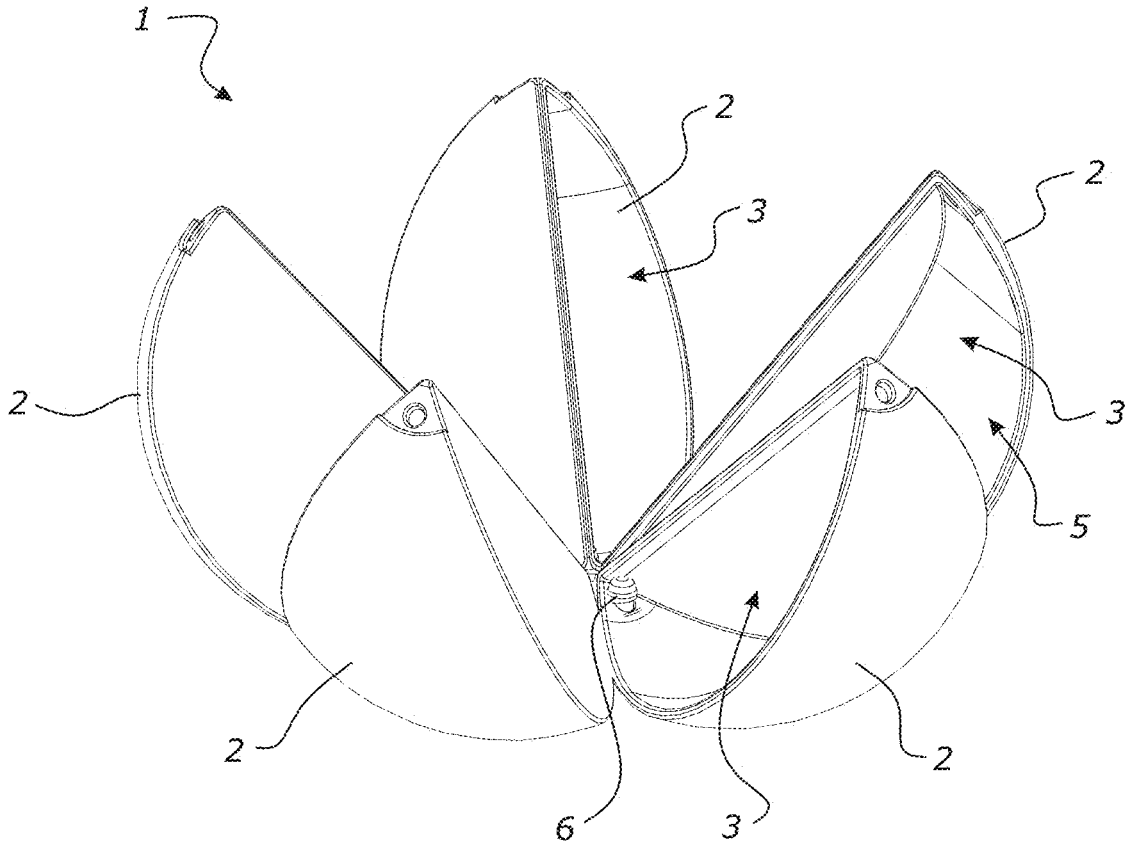
FIGS. 6*a* and 6*b* show two views of an apparatus in which the bodies are moved away from the assembled state.
Figure 6B:
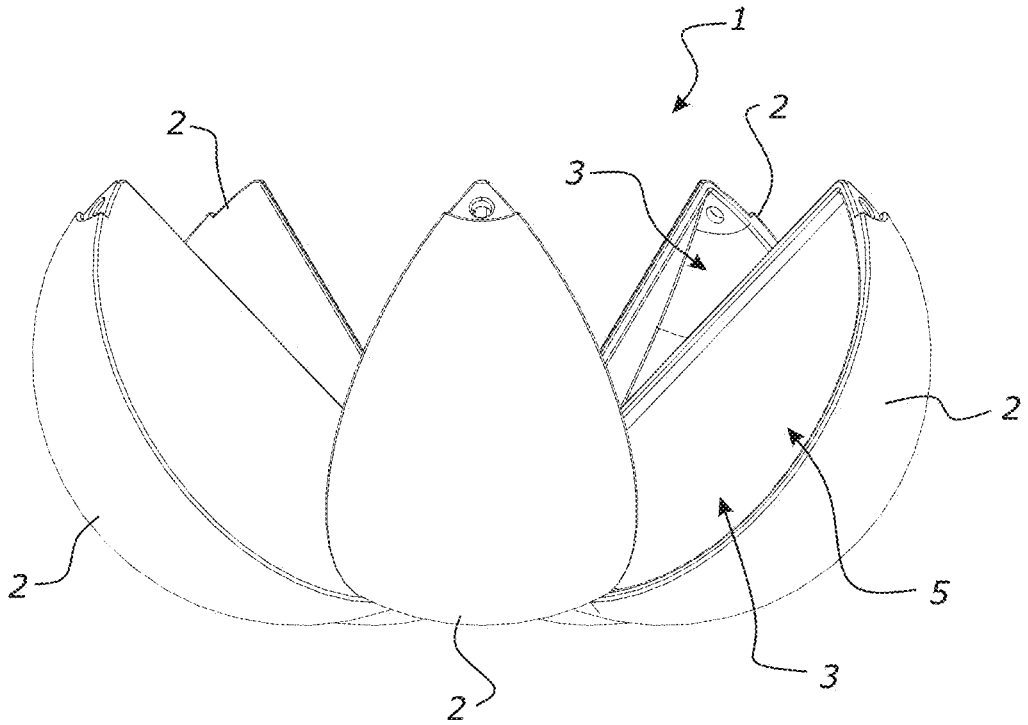
Figure 7A:
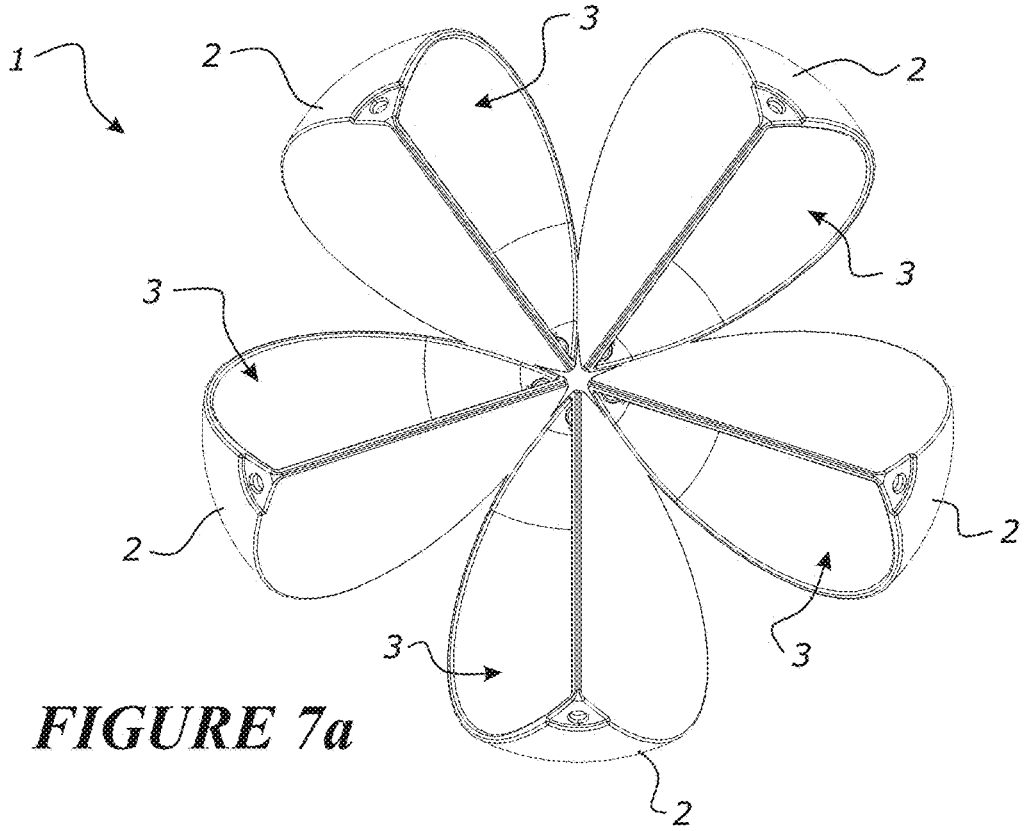
FIG. 7*a* shows a top down view of the configuration of FIGS. 6*a* and 6*b*.
Figure 7B:
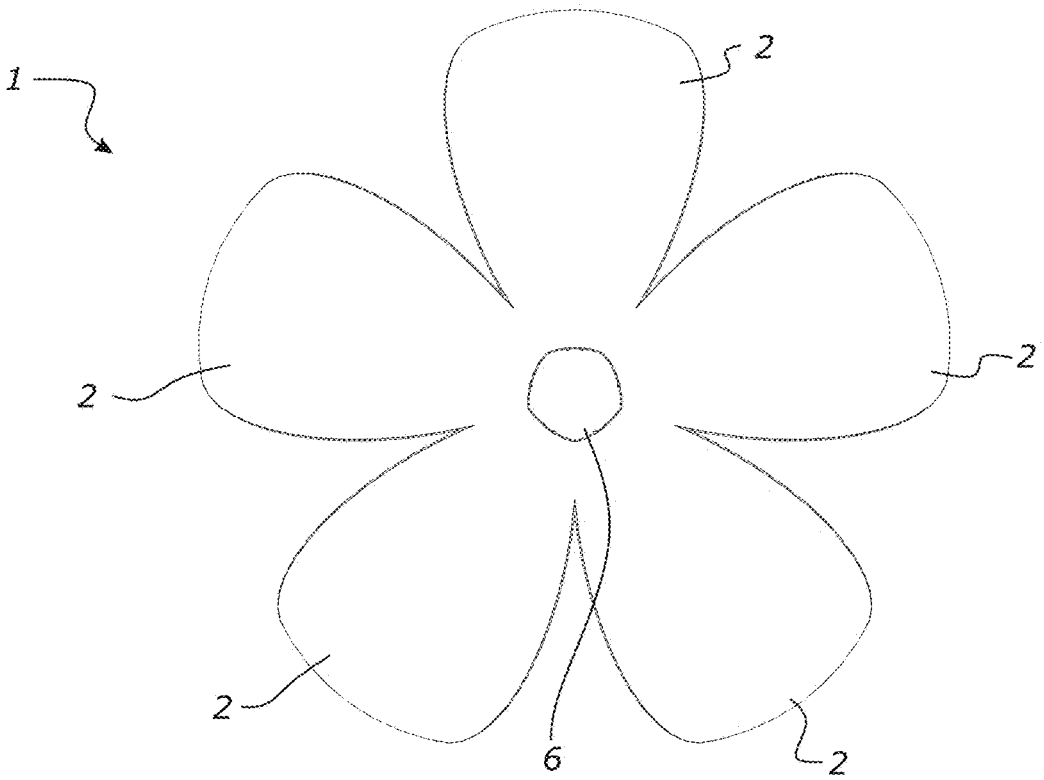
FIG. 7*b* shows a view of the underside of an apparatus in which the bodies are moved away from the assembled state.

An example of how the multiple bodies 2 may be deployed by moving relative to adjacent bodies 2, away from the assembled state, is shown in FIGS. 6*a* and 6*b*. In this example the multiple discrete bodies 2 are segment or sector shaped and, in the assembled state, together define a singular three-dimensional body of spherical shape. The multiple bodies 2 are permanently connected to one another via a hinged, pivoting or otherwise articulating connection 6 at a base region of the apparatus. The multiple bodies articulate at or near a first end 8, each with a second free end 9 which is able to swing radially outward to move its respective body 2 away from the assembled state and/or radially inward back toward the assembled state if so desired. In this embodiment the apparatus 1 may be configured so that all of the multiple bodies 2 can move simultaneously, and thus the apparatus opens like a flower as shown in FIGS. 6*a*-6*b* and 7*a*-7*b*.

Figure 17:
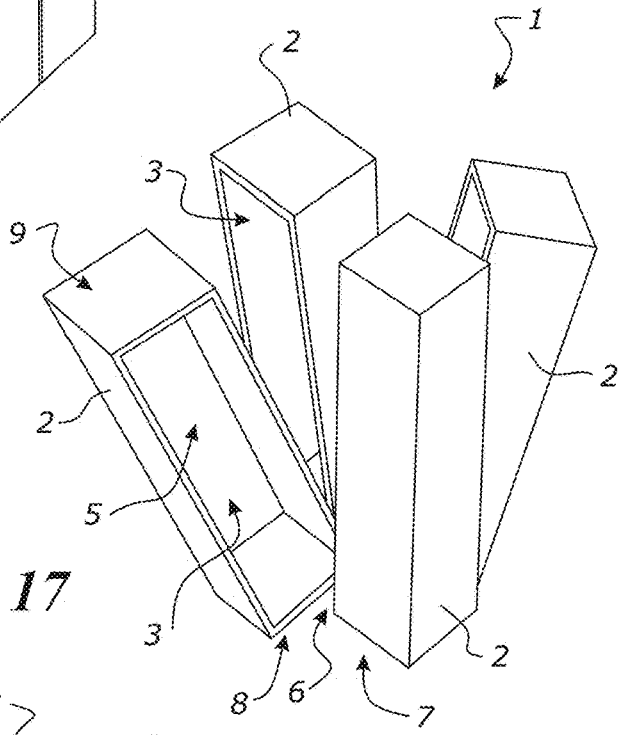
FIG. 17 shows an assembly of another embodiment when the bodies are moved away from their assembled form.
Figure 18:
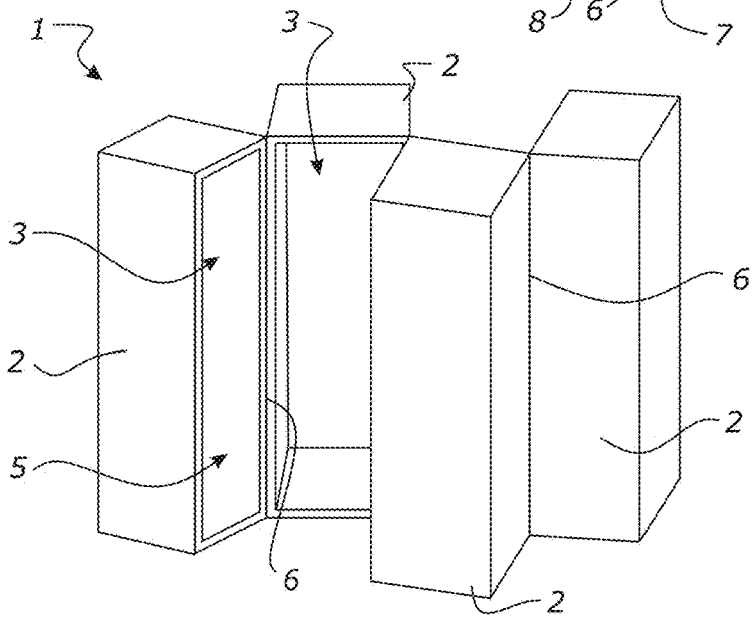
FIG. 18 shows an assembly of another embodiment when the bodies are moved away from their assembled form.

Further examples of how multiple bodies 2 of other shapes may be deployed by moving relative to adjacent bodies 2, away from the assembled state, is shown in FIGS. 17 and 18. In the embodiment of FIG. 17, the multiple bodies 2 are of substantially rectangular form, and are connected to one another via a hinged or pivoting or otherwise articulating connection 6 towards the base region 7 of the apparatus 1. The second free ends 9 of each body 2 may swing radially outward to move its respective body 2 away from the assembled state and/or radially back inward towards the assembled state.

In the embodiment of FIG. 18, multiple bodies 2 of the same rectangular form as seen in FIG. 17 are connected to one another via a hinged or pivoting or otherwise articulating connection 6 along an edge of each body 2. A body 2 may be moved by pivoting of the connections 6 to swing the body away from an adjacent body and thus away from the assembled state, or back inward toward the assembled state. Dependent on the configuration of the location of the connections 6 and the open face 5 of a body 2, an assembly 1 may be provided wherein the cavity 3 of each body 2 having such a cavity is hidden from view when in the assembled state.

Figure 11:
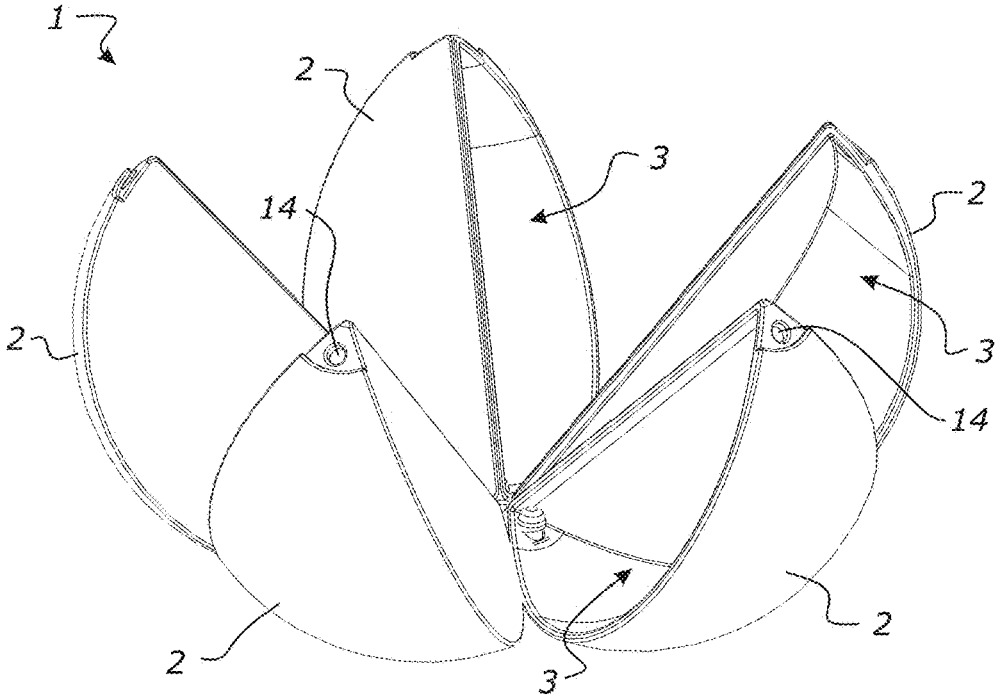
FIG. 11 shows a view of an assembly of bodies moved away from the assembled state and their connection.
Figure 12:
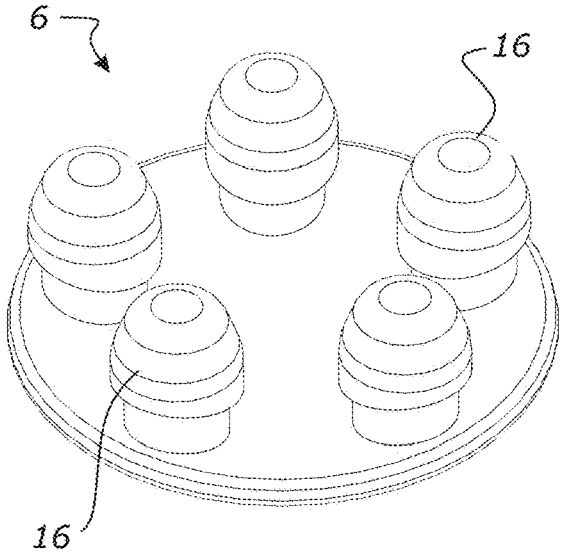
FIG. 12 shows a view of a connection.
Figure 13:
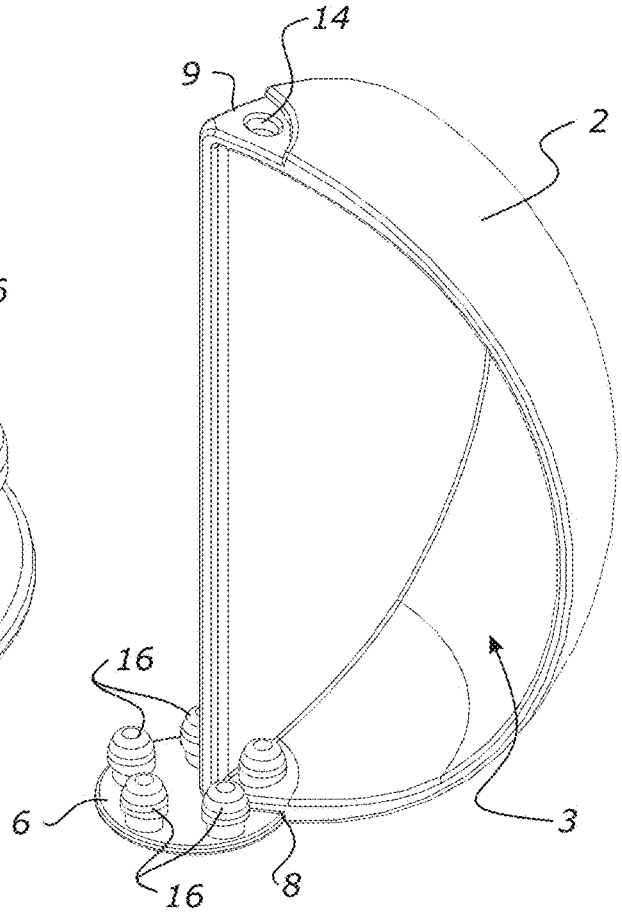
FIG. 13 shows a view of a connection when connected to a single body segment.

Further details of one embodiment of the connection 6 is shown in FIGS. 11-13. FIG. 12 shows the projections 16 which the connection may comprise, the projections 16 each to be associated with a corresponding hole 17 of the first end 8 of a body 2. The projections 17 may be mated with the body 2 by an interference fit of the head of the projection once passed through the hole 17. In a preferred form either or both of the body of the connection 6 or projections 17 may be formed from a resilient or flexible material such that it may accommodate the pivoting or other movement of the bodies 2 away from or towards the assembled state. A view of such a projection 16 mated with a hole 17 of a body 2 is shown in FIG. 13.

Figure 8:
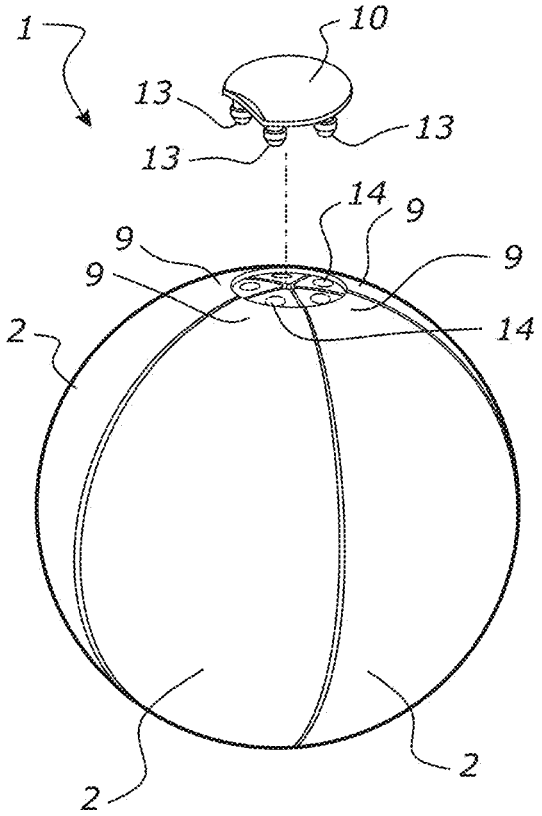
FIG. 8 shows the association between a retainer and an assembly of one embodiment.
Figure 9:
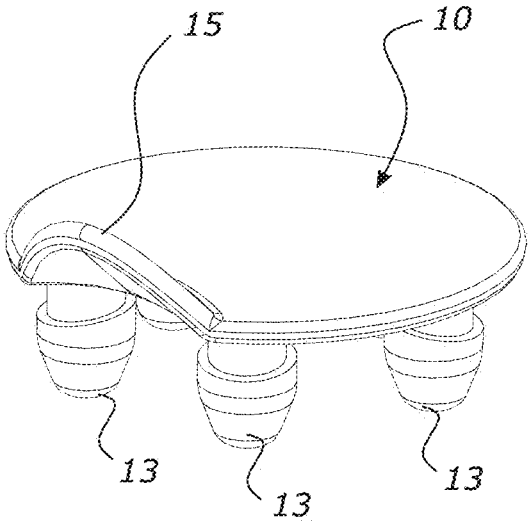
FIG. 9 shows a view of a retainer.
Figure 10:
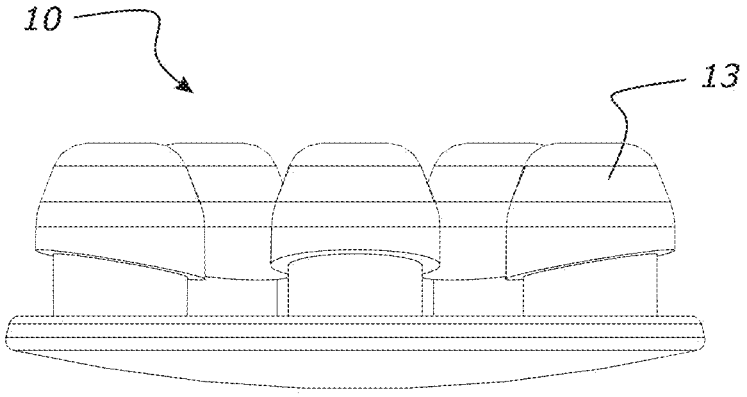
FIG. 10 shows another view of a retainer.

The apparatus 1 may further comprise a retainer or latch 10 (in the exemplary embodiment a circular cap) which engages with each of the multiple bodies 2, preferably at or near the second end 9, in order to prevent their relative movement and thus retain the bodies 2 in their assembled state. One exemplary association of the retainer 10 with the second ends 9 of the bodies 2 is shown in FIG. 8.

In the exemplary embodiment where the retainer 10 is a circular cap, it preferably comprises a plurality of projections 13 which correspond with a hole 14 in the second end 9 of each body to be retained. The connection between the projections 13 and their respective holes 14 is preferably such as to retain the second ends 9 of the multiple bodies 2 in place, yet such that it is able to be released when it is desired to allow or cause at least one second end 9 of a body 2 to move away from the assembled state. In order to facilitate the removal of the retainer 10 from engagement with the holes 14 of the bodies 2 a tab 15 may be provided to enable a user to grasp the retainer 10. The example embodiment shown in FIGS. 1, 3-7*b*, each of the multiple bodies 2 is identical. Even the retainer latch 10 and hinging connection 6 can be implemented while employing multiple bodies 2 of identical form. Although not all embodiments require that the multiple bodies 2 are identical, it is a significant feature of the present design because it greatly simplifies the process and cost for manufacture of the apparatus.

Figure 19:
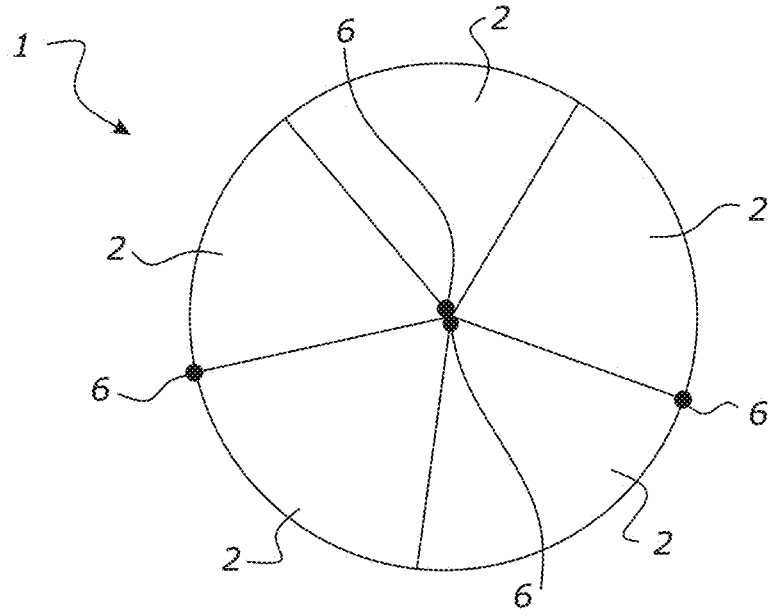
FIG. 19 shows an assembly of another embodiment.
Figure 20:
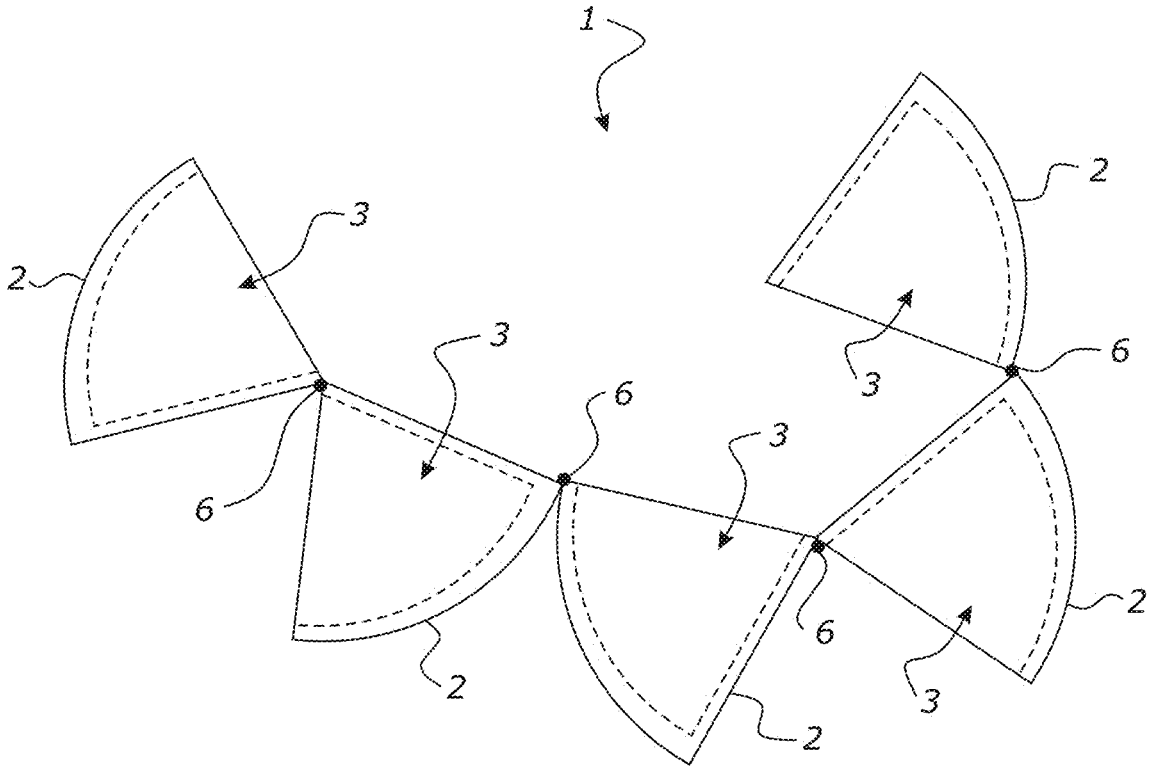
FIG. 20 shows an assembly of another embodiment when the bodies are moved away from their assembled form.

In another example the segment shaped multiple bodies 2 may not be connected via a hinged or pivoting connection 6 at the first end, but instead the connection is along a side edge (between the first and second ends 8, 9) such the bodies 2 move relative one another in a concertina fashion. Such a configuration is shown in FIGS. 18 and 19-20. As the "concertina" is expanded the cavity 3 openings 5 are revealed. In this embodiment it can be seen that the previously described circular cap could be similarly employed to latch the bodies together in the assembled state, however a person skilled in the art would appreciate that other types of retainers 10 could be used to retain the multiple bodies 2 in the assembled state. For example, the same purpose could be served by an elastic band encircling the circumference of the three dimensional sphere formed by the multiple bodies in their assembled state as seen in FIG. 1 or 19.

In yet further examples one or more of the multiple bodies may not be permanently connected to the others, and in some examples all of the bodies 2 may be free of permanent connection with each other. For example the multiple bodies could be of substantially cuboid shape, and may instead assume the assembled state by stacking on top of each other or releasably interlocking.

In some embodiments it is desirable for the apparatus to be configured such that the interior of each cavity 3 can be revealed and/or accessed in sequence, i.e. one at a time. This is to increase the length of the process for revealing toys 4 housed inside the apparatus 1, and thus extending the period of interest and entertainment for the child. In the example embodiment shown in FIG. 18 or 19-20 this could be achieved by applying a selector mechanism to the hinges/pivots 6 so that only one of the segmented multiple bodies 2 can be moved away from the assembled state at a time to reveal its associated cavity 3. However a further convenient way to achieve this is to apply a (preferably opaque) cover or seal 12 over the opening of the cavity 3 which must be removed before any items/toy(s) housed within the cavity can be viewed, accessed and/or withdrawn from the cavity 3.

The cover or seal 12 may be a foil seal, adhesive or heat sealed about the edges of the cavity opening, or may be frangible, edible, deformable or otherwise removable to permit access to the interior of the cavity. For toy items 4 which are stored best in airtight conditions, there could be a packaging advantage in applying the cover or seal to create an airtight seal with the cavity 3 opening 5.

Figure 14A:
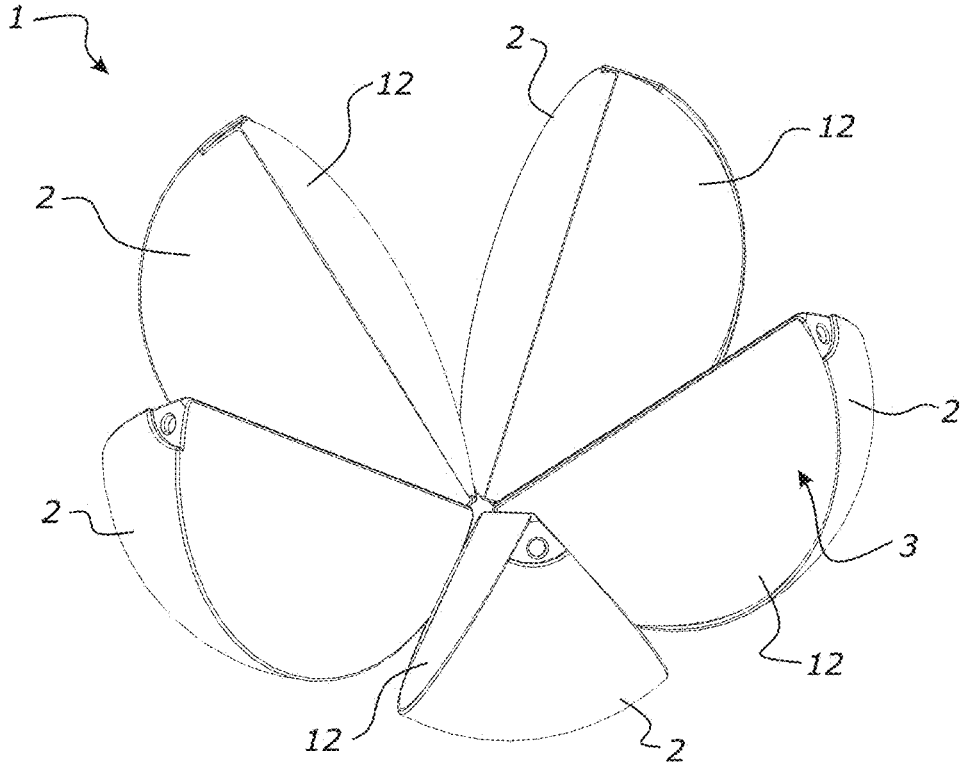
FIG. 14*a* shows an assembly of bodies moved away from the assembled state where the openings of at least some bodies are sealed.

In an exemplary embodiment shown in FIG. 14*a*, the bodies 2 are in capsule form with a peel-off seal 12 covering the entirety of each cavity 3 opening 5. (In this embodiment the cavity opening defines one whole face of the body segment). Even after each body segment 2 has been moved to reveal the cavity opening, it is still necessary to peel off the seal 12 to view, access and/or withdraw and toy 4 inside, thus the cavity 3 interiors can be revealed and/or accessed in sequence, ie one at a time, and there is the option to save a surprise for later by allowing one or more of the capsules to remain sealed.

Figure 14B:
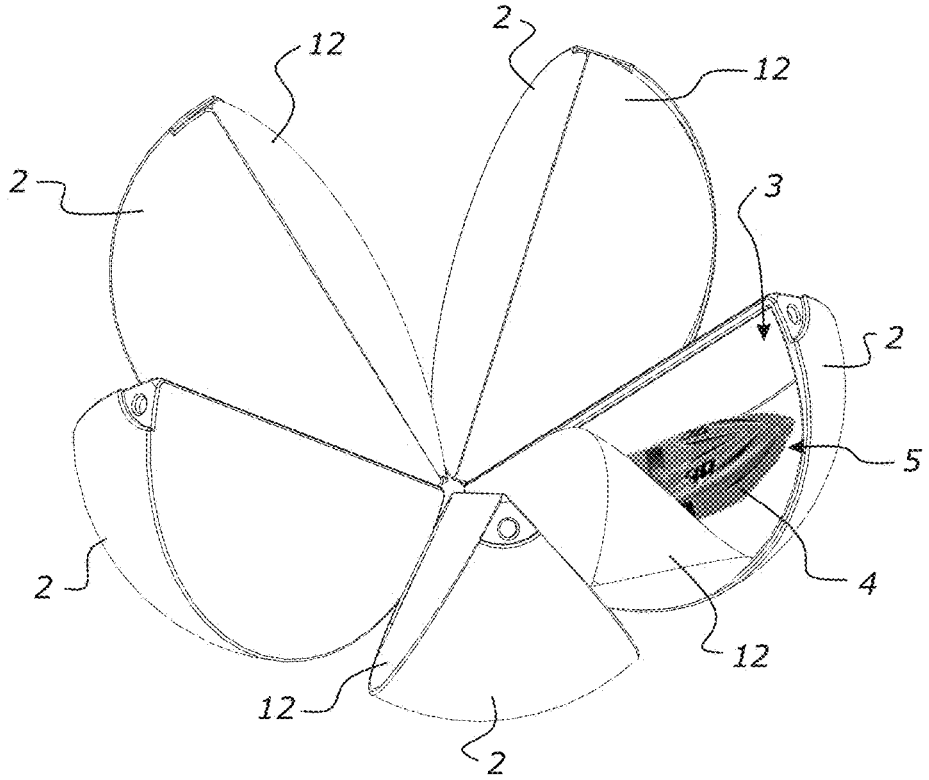
FIG. 14*b* shows the assembly of FIG. 14*a* wherein a seal has been partially removed from an opening.
Figure 15A:
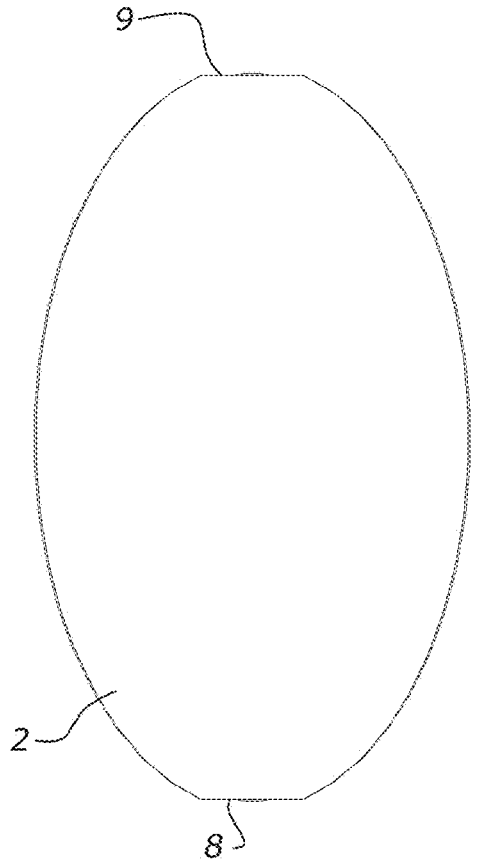
FIG. 15*a-c* show various views of a single body segment.
Figure 15B:
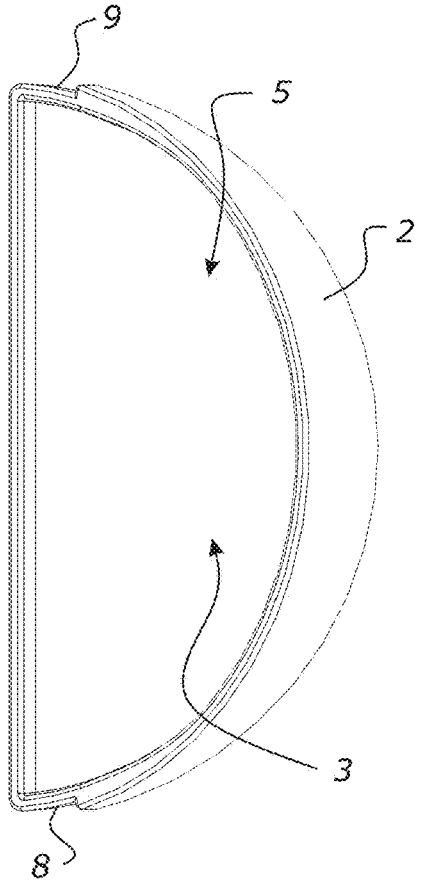
Figure 15C:
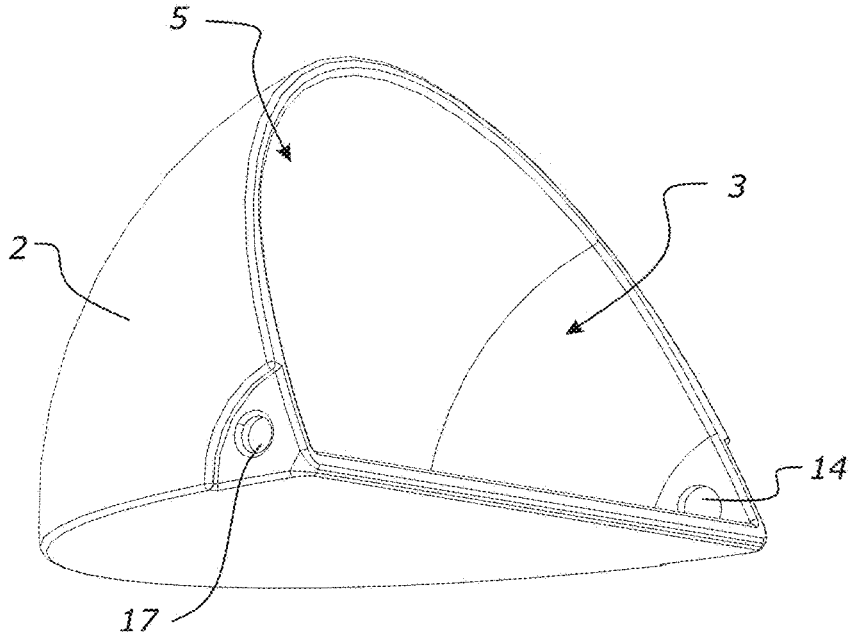
Figure 16:
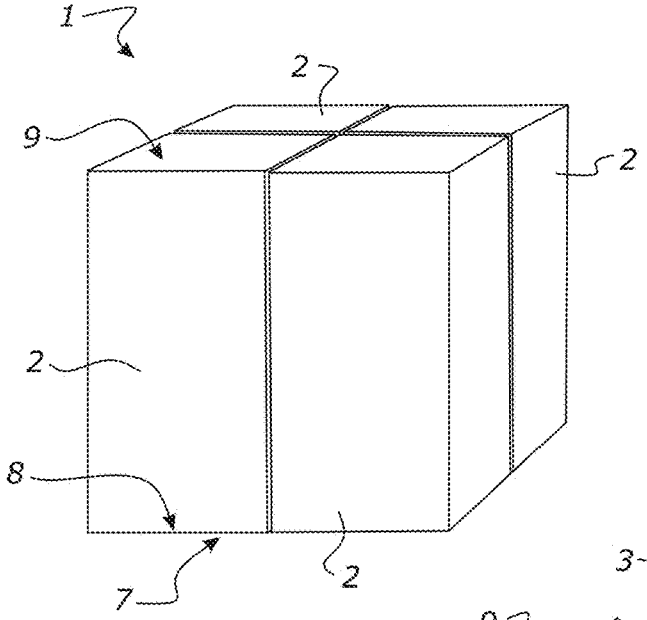
FIG. 16 shows an assembly of another embodiment.

Shown in FIG. 14*b* is the apparatus 1 of FIG. 14*a*, where a seal 12 has been partially peeled away from the opening 5 of the body 2 to reveal a toy 4 held within the cavity 3.

The item in each segment may be a toy like a figurine, eraser, hairclip, model of the Eiffel Tower. Each segment may have a different item. Whilst each segment may be identical in shape, some or all segments of the assembly may be different in shape.

In some embodiments the plurality of bodies may be frangibly connected to the apparatus, or otherwise able to be independently detached. This feature may especially be present in embodiments where the cavity opening is sealed or covered, in which case the individual bodies can be broken off and distributed.

The frangible connection may be provided by a hinged or pivoting connection 6 as previously described which is weakened or provided of a material able to be torn by a user. Such a user could be someone of adult strength or more likely could be a child. One such method of frangible or tearable connection 6 may be provided using the connection 6 shown in FIGS. 11-13 wherein the projections 16 are able to be torn away from the body of the connection 6.

It will be appreciated that the above embodiments are disclosed by way of example only, and that further variations are possible without departing from the spirit and scope of the invention.

The invention claimed is:

1. An apparatus comprising at least three sector shaped bodies which can be assembled together in an assembled state to form a spherical body wherein each of the plurality of bodies define a cavity within each of which a different type of child's toy is received, and wherein said cavity has a cavity opening through which said child's toy can be withdrawn from the cavity, and wherein said cavity opening is obstructed by an adjacent one of the plurality of bodies when the plurality of bodies are in the assembled state, but can be exposed by moving one or more of said plurality of bodies away from the remainder of the plurality of bodies.

2. Apparatus of claim 1 wherein the plurality of bodies comprises between three and six bodies.

3. Apparatus of claim 1 wherein the apparatus is configured such that once the plurality of bodies have been assembled together in the assembled state, each one of the plurality of bodies may be moved away from the position which it assumes in the assembled state independently of the remainder of the plurality of bodies, which remaining bodies may stay in the position that they assume when in the assembled state used.

4. Apparatus as claimed in claim 1 wherein the plurality of bodies are connected to one another via a common hinged or pivoting connection.

5. Apparatus as claimed in claim 4 wherein the common hinged or pivoting connection is at or near a base region of the apparatus.

6. Apparatus as claimed in claim 4 wherein the plurality of bodies are connected at a first end, and have a second free end which is able to swing about the hinge in order to move the bodies away from and back toward the assembled state.

7. Apparatus as claimed in claim 1 wherein a latch is provided to restrict movement of one or more of the plurality of bodies away from the assembled state.

8. Apparatus as claimed in claim 7 wherein the latch engages with each of the plurality of bodies to restrict their relative movement.

9. Apparatus as claimed in claim 1 wherein each cavity opening is obstructed by a removable seal.

10. An assembly of at least three segments of a spherical body, the assembly for obscuring from view a different type of child's toy held in each segment of the assembly of segments at least when the segments are in an assembled form, wherein said segments are sector shaped so as to permit assembly together in an assembled form of a single spherical body, and wherein the segments are associated together so as to be able to transform from the assembled form towards an expanded form upon the disassociation of a retainer element from the assembly.

* * * * *